US012209481B1

(12) United States Patent
Patsy et al.

(10) Patent No.: US 12,209,481 B1
(45) Date of Patent: Jan. 28, 2025

(54) FRAC PLUG DEVICE FOR HIGH EXPANSION AT THE SETTING POSITION

(71) Applicants: CNPC USA Corporation, Houston, TX (US); BEIJING HUAMEI, INC., Beijing (CN); CHINA NATIONAL PETROLEUM CORPORATION, Beijing (CN)

(72) Inventors: Matthew Patsy, Richmond, TX (US); Jianpeng Yue, Sugar Land, TX (US); Min Mark Yuan, Katy, TX (US); Peng Cheng, Houston, TX (US); Yu Liu, Beijing (CN); Huailiang Liu, Beijing (CN)

(73) Assignees: CNPC USA Corporation, Houston, TX (US); Beijing Huamei, Inc., Beijing (CN); China National Petroleum Corporation, Beijing (CN)

( * ) Notice: Subject to any disclaimer, the term of this patent is extended or adjusted under 35 U.S.C. 154(b) by 0 days.

(21) Appl. No.: 18/472,443

(22) Filed: Sep. 22, 2023

(51) Int. Cl.

| | |
|---|---|
| ***E21B 33/128*** | (2006.01) |
| ***E21B 33/12*** | (2006.01) |
| ***E21B 33/129*** | (2006.01) |
| ***E21B 43/26*** | (2006.01) |

(52) U.S. Cl.
CPC ..... *E21B 33/1291* (2013.01); *E21B 33/1208* (2013.01); *E21B 43/26* (2013.01)

(58) Field of Classification Search
CPC ..... E21B 33/12; E21B 33/128; E21B 33/129
See application file for complete search history.

(56) References Cited

U.S. PATENT DOCUMENTS

| | | | | |
|---|---|---|---|---|
| 3,493,046 | A | 2/1970 | Johnson et al. | |
| 5,566,762 | A * | 10/1996 | Braddick | E21B 23/01 166/117.6 |
| 5,678,635 | A * | 10/1997 | Dunlap | E21B 33/134 166/134 |
| 6,241,017 | B1 | 6/2001 | Doane et al. | |
| 9,650,858 | B2 * | 5/2017 | Williamson | E21B 33/128 |
| 10,364,639 | B2 | 7/2019 | Svartvatn et al. | |
| 10,794,132 | B2 | 10/2020 | Mhaskar et al. | |
| 11,255,151 | B2 | 2/2022 | Nichols et al. | |
| 11,261,683 | B2 | 3/2022 | Kellner et al. | |

(Continued)

FOREIGN PATENT DOCUMENTS

| | | |
|---|---|---|
| CN | 109973043 | 7/2019 |

*Primary Examiner* — Kenneth L Thompson
(74) *Attorney, Agent, or Firm* — Craft Chu PLLC; Andrew W. Chu

(57) ABSTRACT

The frac plug device is a wedge type or ramp type frac plug that can seal at a setting position in a large diameter portion of the borehole. The thickness, taper angle, and dimensions of components for passing through the narrowest portion of the borehole during deployment no longer limit the radial expansion. The frac plug device includes a core cone, a segmented cone, a slip device, a segmented cap member, and a core cap member. A simplified setting action sets the high expansion of the slip device by the core cone and the segmented cone. The segmented cone and the segmented cap member increase expansion of the slip device, and the segmented cap member and the core cap member lock the slip device around the core cone in the final expansion configuration at the maximum radial expansion for large diameter portions of the borehole.

18 Claims, 6 Drawing Sheets

(56) References Cited

U.S. PATENT DOCUMENTS

| | | | | |
|---|---|---|---|---|
| 11,555,364 | B2 * | 1/2023 | Mitchell | E21B 23/06 |
| 11,732,546 | B1 * | 8/2023 | Qiu | E21B 33/1208 166/387 |
| 2017/0130553 | A1 | 5/2017 | Harris et al. | |
| 2018/0016864 | A1 | 1/2018 | Parekh et al. | |

* cited by examiner

FIG. 1
PIOR ART
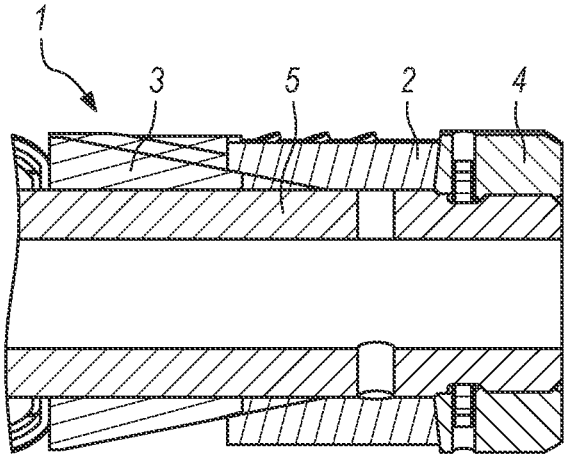
FIG. 2
PIOR ART
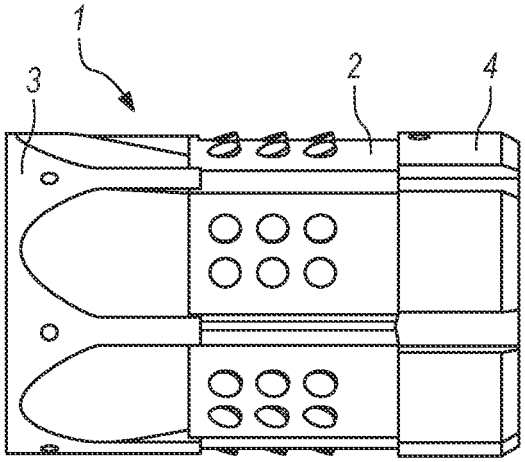
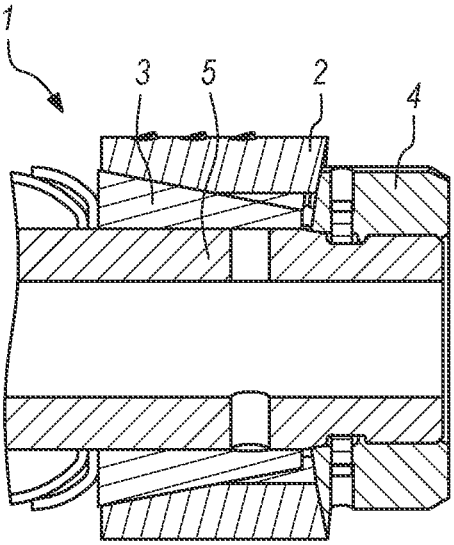
FIG. 3
PIOR ART
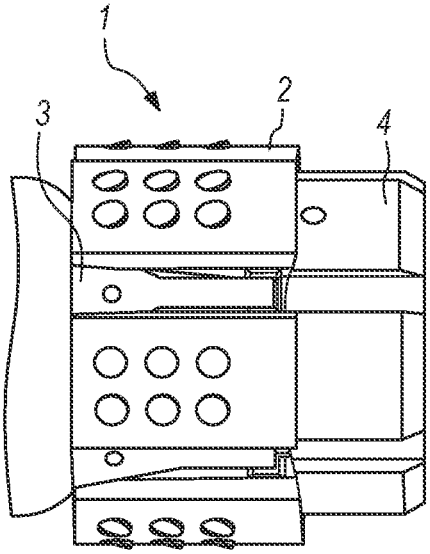
FIG. 4
PIOR ART

FRAC PLUG DEVICE FOR HIGH EXPANSION AT THE SETTING POSITION

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a frac plug device that has a multiple stage full expansion configuration to seal at wide setting positions in the wellbore. The frac plug sets a seal for isolating zones in large wellbores. Even more particularly, the present invention relates to a frac plug with a segmented cone and a segment cap member to increase expansion diameter of the slip device at the wide setting position in the wellbore. 2. Description of Related Art Including Information Disclosed Under 37 CFR 1.97 and 37 CFR 1.98.

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tool with an isolation valve.

In the conventional process, the frac plug or frac plug device is run-in to a downhole location. When located in the correct place, the setting tool that traveled with the frac plug device will set the packer, i.e. expand the frac plug against the walls of the borehole. Then, the settling tool is removed. The frac plug still must be activated in order seal the zone. The frac plug is sealed to the borehole, but fluid still flows through the packer. Conventionally, a frac ball is dropped into the borehole. The frac ball travels to the downhole location to sit on a ball seat, which triggers expansion of the frac plug to the borehole walls and can even be incorporated as part of the seal across the frac plug. Fracking can commence with the seal across the packer. The frac fluids are only delivered to the isolated zone, and production fluids are only harvested from the isolated zone.

There are also simplified, compact, and condensed frac plug systems comprised of different material compositions. Fewer components and selection of material composition allow for frac plugs to the removed more easily after use. As the material selection of components is controlled, the use of drilling out removal or the use of dissolving metallic or non-metallic compositions can be selected. As the number of components is reduced, the amount of milling out or the amount of dissolving chemicals can be reduced. Some of these simplified and condensed frac plug systems are wedge type or ramp type frac plug systems comprised of a wedge or ramp, a sealing ring, and a slip device.

FIGS. 1-4 show a prior art wedge type or ramp type frac plug system 1 being comprised of a slip 2, a wedge 3, a cap 4, and a mandrel 5. The wedge 4 has a tapered surface that slides into the slip 2. As the thicker portion of the wedge 4 enters into the slip 2, the slip 2 expands in diameter to reach the borehole wall. The cap 4 is mounted on the mandrel 5 to hold the position of the slip 2 so that the slip 2 is forced to expand, instead of being pushed along the mandrel 5 by the wedge 3. The diameter of the wedge 3 and the diameter of the slip 2 determines the radial expansion of the frac plug system 1.

The limitation of these simplified quick setting frac plugs is the amount of radial expansion. The wedge or cone expands the slip device to the widest diameter of the cone. This amount of radial expansion must happen over the length of the cone. The length and widest diameter of the cone define how much radial expansion and how fast and how far the cone must move in order to reach the widest diameter.

The length and widest diameter of the cone are already limited to the size of the borehole. That is, the widest diameter must be small enough to travel through the borehole in the run-in configuration. The widest diameter cannot be larger than the borehole to be traveled. Also, the length of the cone is limited by the angle of the cone surface from the initial diameter to the widest diameter. If the angle is too steep, then there is no sufficient force to deploy the slip device. If the angle is too shallow, then the slip device will deploy too easily and prematurely. The slip device must also be dimensioned to travel through the borehole. Even in the run-in configuration, the length and widest diameter of the slip device are restricted to initial physical dimensions.

The radial expansion of the slip device is limited to respective dimensions of the cone and the slip device. For large wellbores or boreholes and casings with large diameters, the frac plug may not be able to radially expand sufficiently to seal against these larger diameters.

Various patents and publications have addressed expansion at the setting position with additional components beyond the wedge or cone and slip device. U.S. patent Ser. No. 10/794,132, issued on 6 Oct. 2020 to Mhaskar et al. discloses an expansion ring with an initial run-in configuration beyond the thickness of the slip segments and the cone. However, the expansion ring is expanded to match the slip segments in the extended configuration for sealing at the setting position. U.S. patent Ser. No. 11/255,151, issued on 22 Feb. 2022 to Nichols et al., adds another version of an expansion ring with a different relationship to the wedge and slip device. The final extended diameter still remains based on the wedge diameter and the slip thickness. US Patent Publication No. 2017/0130553, published on 11 May 2017 for Harris et al, discloses collet fingers to press the wedge, which expands the slip device. U.S. Pat. No. 3,493,046, issued on 3 Feb. 1970 to Johnson et al, describes adding another set of cones and slip devices.

A prior art frac plug device with multiple cones is another prior art solution to expansion at the setting position. U.S. patent Ser. No. 10/364,639, issued on 30 Jul. 2019 to Svartvatn et al, U.S. patent Ser. No. 11/261,683, issued on 1 Mar. 2022 to Kellner et al, and CN109973043 5 Jul. 2019 Guo Daiin, et al, all disclose a frac plug system with more than one cone. The two cones are cooperative and placed in opposite directions so as to expand the slip device from both sides of the slip device. The diameter expansion is still limited to the diameter of the cone and the thickness of the slip segments of the slip device. The prior art frac plugs lack the structures and function to expand beyond the thickness of the slip segments and thickness of the cone as the final expansion diameter for sealing a wide borehole.

It is an object of the present invention to provide a frac plug device with a final expansion diameter to span large wellbores and casings.

It is another object of the present invention to provide a simplified frac plug device with a final expansion diameter to span large wellbores and casings with the fewest components.

It is an object of the present invention to provide a frac plug device with high expansion at the setting position in the borehole.

It is another object of the present invention to provide a frac plug device with a multiple stage expansion to reach a full expansion configuration at the setting position in the borehole.

It is still another object of the present invention to provide a frac plug device with a segmented cone and a segmented cap member to determine the full expansion configuration.

It is yet another object of the present invention to provide a frac plug device with slip segments stabilized in the full expansion configuration.

It is another object of the present invention to provide a frac plug device with slip segments locked around the cone in the full expansion configuration when set by the segmented cone and the segmented cap member.

It is an object of the present invention to provide a method for sealing a borehole at a wide setting position with a wedge type or ramp type frac plug.

These and other objectives and advantages of the present invention will become apparent from a reading of the attached specification, drawings and claims.

BRIEF SUMMARY OF THE INVENTION

Embodiments of the present invention include a frac plug device comprising a core cone, a segmented cone, a slip device, a segmented cap member, and a core cap member. The frac plug device has a run-in configuration for deployment through the borehole to a setting position. The thickness, taper angles and dimensions of the core cone, segmented cone, slip device, segmented cap member, and core cap member in the run-in configuration fit through the narrowest portions of the borehole to reach the setting position. The frac plug device has an initial expansion configuration and a final expansion configuration for sealing at the setting position in a larger diameter portion of the borehole. The frac plug device has a final expansion configuration for maximum radial expansion to stably seal in these larger portions of the borehole. The frac plug device is a wedge type or ramp type frac plug with a simplified setting action. The radial expansion of the frac plug device is no longer limited to respective dimensions of the cone and the slip device.

Embodiments of the core cone include a first core cone end, a second core cone end, and an inner core cone channel extending from the first core cone end to the second core cone end. A mandrel can extend through the inner core cone channel for the setting action of the frac plug device. The core cone has a tapered outer core cone surface decreasing in outer core cone diameter toward the second core cone end.

Embodiments of the segmented cone include a first segmented cone end and a second segmented cone end. The segmented cone is comprised of a plurality of cone segments. Each cone segment has an inner cone segment surface and a tapered outer cone segment surface that determines an outer segment diameter. The tapered outer segment surface tapers toward the second segmented cone end. The inner cone segment surface is in sliding engagement with the tapered outer core cone surface of the core cone.

Embodiments of the slip device include a first slip end and a second slip end. The slip device is comprised of a plurality of slip segments. Each slip segment has an inner slip segment surface and an outer slip segment surface. There can also be an engagement means for the borehole on the outer slip segment surface. The inner slip segment surface is in sliding engagement with a respective tapered outer segmented cone surface of a cone segment. Each slip segment is expanded with a respective cone segment. The radial expansion of the outer slip diameter is determined by the slip device and the outer segment diameter of the cone segments as set by the outer core diameter of the core cone.

Embodiments of the segmented cap member have a first segmented cap end and a second segmented cap end. The segmented cap member is comprised of a plurality of cap segments. Each cap segment has an inner tapered cap segment surface and an outer tapered cap segment surface. The inner slip segment surface is in sliding and locked engagement with a respective outer tapered cap segment surface of each cap segment. Each slip segment is expanded with a respective cap segment and a respective cone segment. The radial expansion of the outer slip diameter is supported by the cap segments, which hold the position of the slip segments around the segmented cone and the core cone.

Embodiments of the core cap member have a first core cap end and a second core cap end. There is an inner core cap channel extending from the first core cap end to the second core cap end. The mandrel can extend through the core cone and the inner core cap channel for the setting action of the frac plug device. The inner tapered cap segment surface of each cap segment is in sliding and locked engagement with the tapered outer core cap surface. The core cap member holds the cap segments around the core cap member.

In the full expansion configuration, the second core cone end, the second segmented cone end, the first segmented cap end, and the first core cap end are within the slip device. The outer slip diameter of the slip device in the full expansion configuration is comprised of the slip device and the outer segment diameter of the segmented cone as set by the outer core cone diameter of the core cone. The maximum radial expansion in the full expansion configuration is stable and locked by the segmented cap member and core cap member.

Embodiments of the frac plug device also include a segmented cone support ring and a segmented cap member support ring. There can also be at least one slip support ring. The support rings control the amount of force needed to expand the corresponding pluralities of slip segments, cone segments, and cap segments. Premature expansion is prevented so that the frac plug device can be expanded only at the desired setting position in the borehole.

Some embodiments of the slip segment of the slip device include the inner slip segment surface having a first tapered inner slip portion and a second tapered inner slip portion. The first tapered inner slip portion is in sliding engagement with a respective tapered outer segmented cone surface of a corresponding cone segment. The second tapered inner slip portion is in sliding and locked engagement with a respective outer tapered cap segment surface of a corresponding cap segment.

In the sliding and locked engagement between the slip segments and the cap segments. The outer tapered cap segment surface has an outer tapered cap groove, and the inner slip segment surface has an inner slip ridge. In the sliding and locked engagement between the cap segments and the core cap member, the inner tapered cap segment surface has an inner tapered cap ridge, and the tapered outer core cap surface has an outer cap groove. The cap segments cannot radially shift around the core cap member and are held in place around the core cap member. The slip segments are locked to the cap segments so that the slip segments also remain in the final expansion configuration.

The present invention includes the method for sealing a borehole with the frac plug device. The method includes the step of deploying the frac plug device in a borehole to a downhole location with the frac plug device in the run-in configuration. The method also includes moving the segmented cone toward the segmented cap member within the slip device and placing the frac plug device in the initial expansion configuration. Then, the method includes the step of placing the frac plug device in the full expansion configuration. Embodiments of the method include the step of placing the frac plug device in the full expansion configuration further comprising the step of locking the slip device around the core cone in the full expansion configuration.

The high expansion of the slip device at the setting positions in larger diameter portions of the borehole allows the frac plug device to seal in the desired locations, even if the borehole is wider. The segmented cap member and core cap member lock the slip segments around the core cone so that the risk of misalignment and collapse is reduced.

BRIEF DESCRIPTION OF THE SEVERAL VIEWS OF THE DRAWINGS

FIG. 1 is a sectional view of an embodiment of a prior art frac plug device in an initial run-in configuration.

FIG. 2 is a side elevation view of the embodiment of the prior art frac plug device in an initial run-in configuration, according to FIG. 1.

FIG. 3 is a sectional view of an embodiment of the prior art frac plug device in a fully extended configuration.

FIG. 4 is a side elevation view of the embodiment of the prior art frac plug device in a fully extended configuration, according to FIG. 3.

DETAILED DESCRIPTION OF THE INVENTION

A frac plug has a radial expansion limited by the dimensions of the component parts, which are further limited by being able to pass through the narrowest portion of the borehole during deployment to the setting position. Adding more components, like expansion rings and another cone, can be implemented in a complex frac plug with double sided slips and collet fingered rings. For wedge type or ramp type frac plugs, those added complexities are not compatible with the simplified setting action. The frac plug device 10 of the present invention can comply with the dimension limitations set by passing through the narrowest portion of the borehole and incorporate additional components compatible with the simplified setting action of a wedge type or ramp type frac plug. The radial expansion of the frac plug device 10 of the present invention is no longer limited to respective dimensions of the cone and the slip device. For a setting position in the wide and large diameter portion of boreholes and casings, the wedge type frac plug device 10 of the present invention has a full expansion configuration to seal against these larger diameters.

Figure 5:
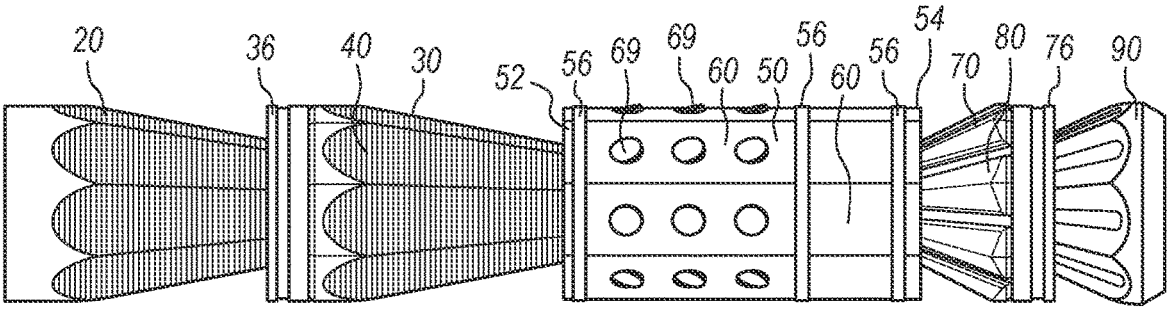
FIG. 5 is a side elevation view of an embodiment of the frac plug device in a run-in configuration, according to the present invention.
Figure 6:
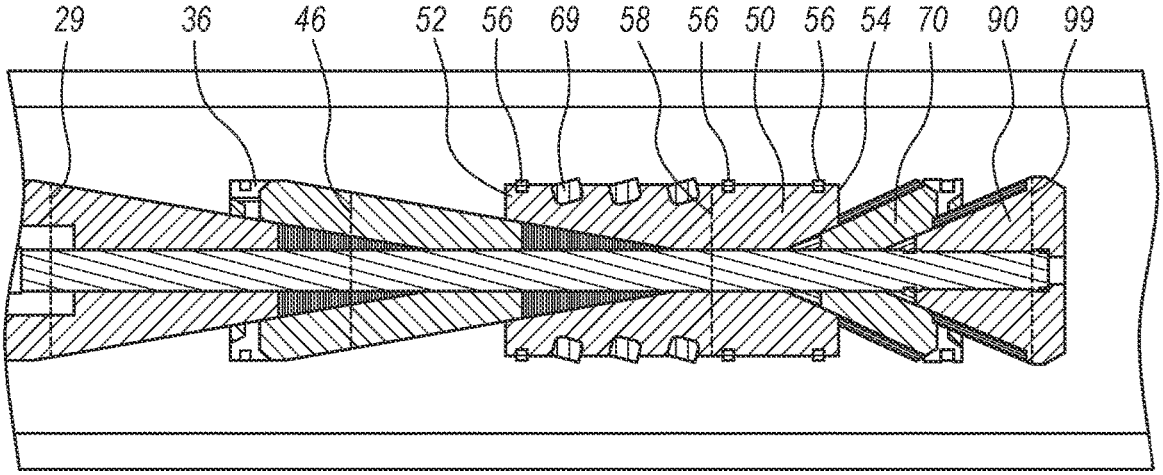
FIG. 6 is a sectional view of the embodiment of the frac plug device in the run-in configuration, according to the present invention.
Figure 7:
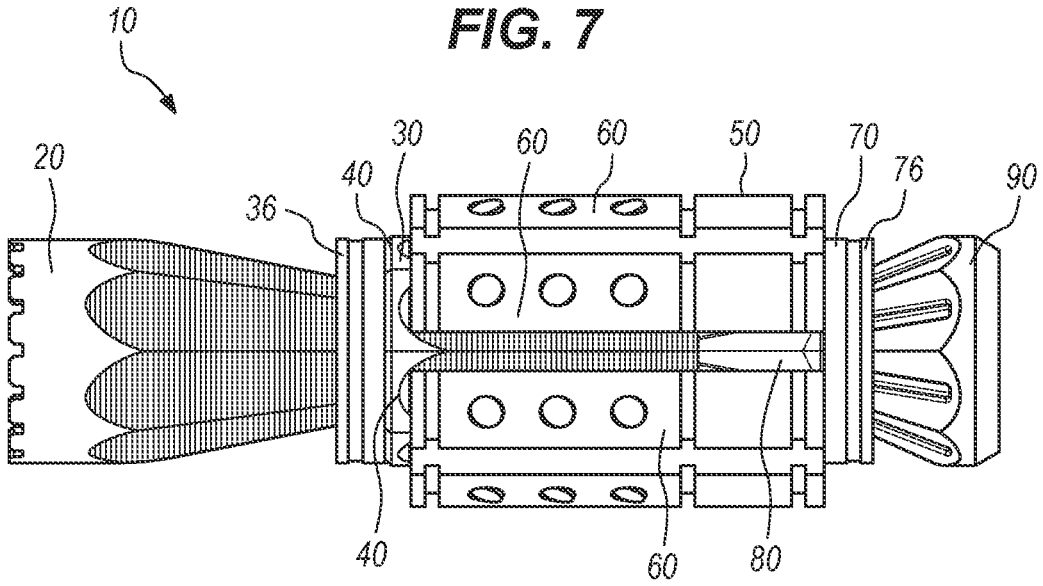
FIG. 7 is a side elevation view of an embodiment of the frac plug device in an initial expansion configuration, according to the present invention.
Figure 8:
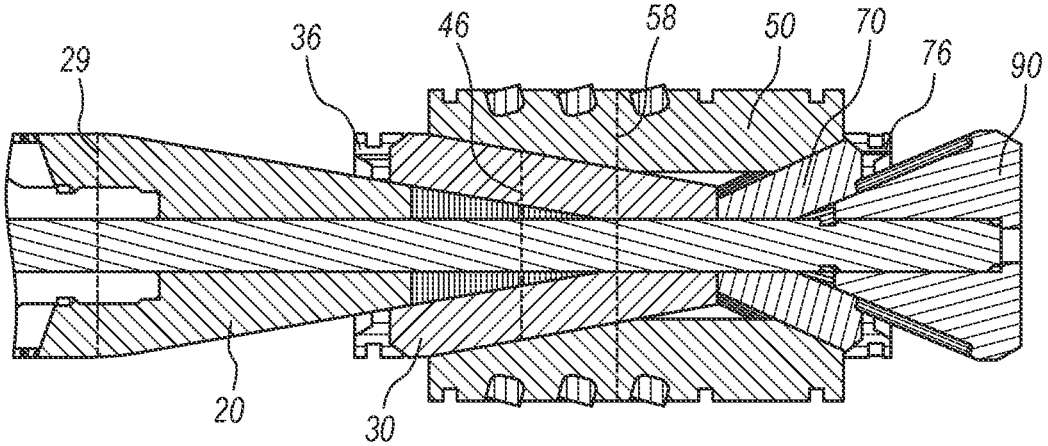
FIG. 8 is a sectional view of the embodiment of the frac plug device in the initial expansion configuration, according to the present invention.
Figure 9:
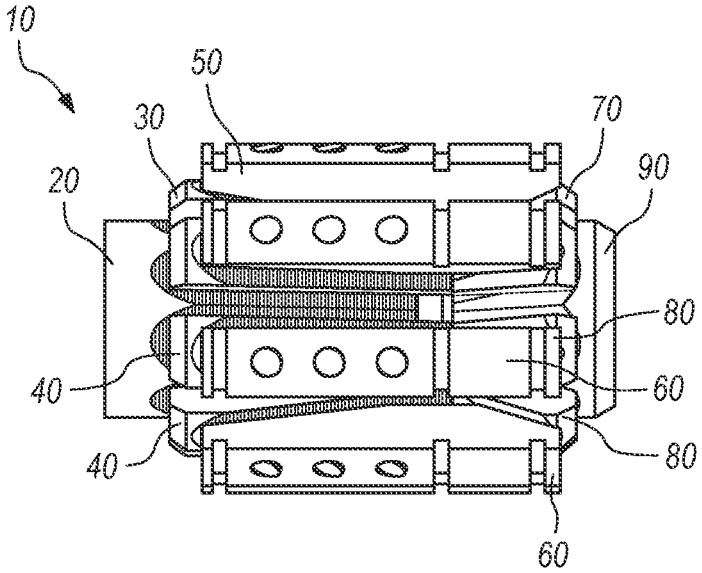
FIG. 9 is a side elevation view of an embodiment of the frac plug device in a final expansion configuration, according to the present invention.
Figure 10:
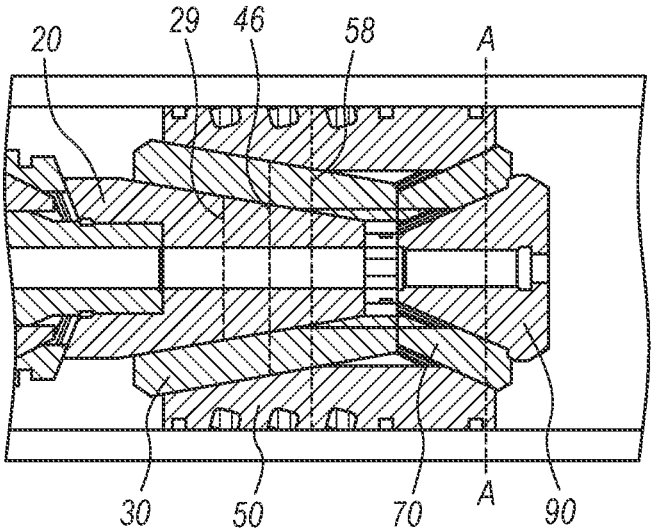
FIG. 10 is a sectional view of the embodiment of the frac plug device in the final expansion configuration, according to the present invention.

FIGS. 5-17 show a frac plug device 10 comprising a core cone 20, a segmented cone 30, a slip device 50, a segmented cap member 70, and a core cap member 90, according to embodiments of the present invention. The frac plug device 10 has a run-in configuration for deployment into the borehole to the setting position, as shown in FIGS. 5-6. The frac plug device 10 must pass through the borehole, including through the narrowest portions. The thickness, taper angles, and dimensions of the components are limited to fitting through these narrowest portions of borehole, including making turns and twists through the borehole. The frac plug device 10 has a final expansion configuration for maximum radial expansion at the setting position in the borehole, as shown in FIGS. 9-10. The setting position can now be stably sealed in larger portions of the borehole. The simplified wedge type or ramp type frac plug device 10 achieves high expansion at these larger portions of the borehole. The outer slip diameter 58 is reached with the same simplified setting action of a wedge type frac plug with greater radial expansion than the thickness of the core cone 20 and the slip device 50. The frac plug device 10 also has an initial expansion configuration as an intermediate radial expansion to seal at a setting position in the borehole that requires less than the maximum radial expansion of the frac plug device 10, as shown in FIGS. 7-8. The initial expansion configuration is also an intermediate configuration as the frac plug device 10 moves from the run-in configuration to the full expansion configuration at the setting position in the larger portion of the borehole, which requires the maximum radial expansion.

Figure 11:
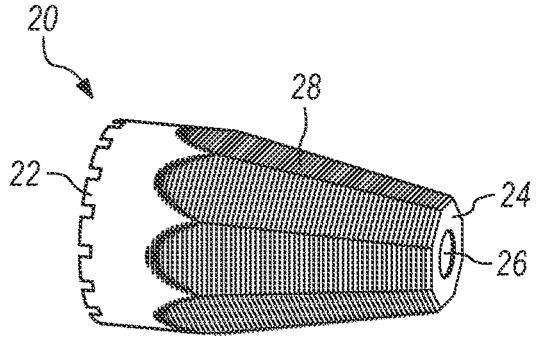
FIG. 11 is a perspective view of an embodiment of a core cone of the frac plug device, according to the present invention.

FIG. 11 shows an embodiment of the core cone 20 from FIGS. 5-10. The core cone 20 has a first core cone end 22 and a second core cone end 24 opposite the first core cone end. There is an inner core cone channel 26 extending from the first core cone end 22 to the second core cone end 24. A mandrel or other tubular member can extend through the inner core cone channel 26 to implement the setting action of the frac plug device 10. FIG. 11 also shows a tapered outer core cone surface 28 decreasing in outer core cone diameter 29 toward the second core cone end 24. The outer core cone diameter 29 remains limited in thickness, taper angle, and dimension by the frac plug device 10 needing to pass through the narrowest portions of the borehole to reach the setting position.

Figure 12:
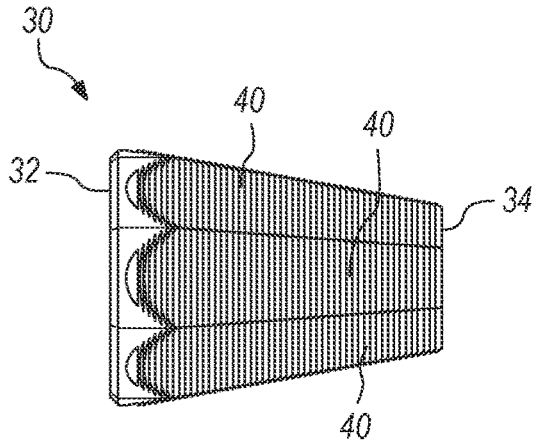
FIG. 12 is a perspective view of an embodiment of a segmented cone of the frac plug device, according to the present invention.
Figure 13:
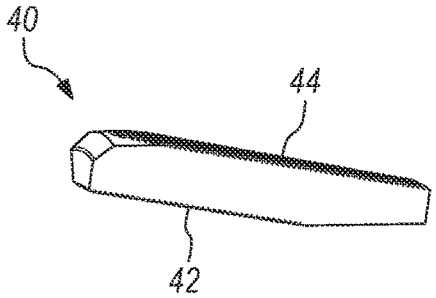
FIG. 13 is a perspective view of an embodiment of a cone segment of the segmented cone of the frac plug device in FIG. 12.

Embodiments of the segmented cone 30 and a cone segment 40 from FIGS. 5-10 and 17 are shown in FIGS. 12-13. The segmented cone 30 has a first segmented cone end 32 and a second segmented cone end 34 opposite the first segmented cone end 32. FIG. 12 shows that the segmented cone 30 is comprised of a plurality of cone segments 40. As shown in FIG. 13, each cone segment 40 of the plurality of cone segments 40 has an inner cone segment surface 42 and a tapered outer cone segment surface 44 opposite the inner cone segment surface 42. The tapered outer segment surface 44 has an outer segment diameter 46. The taper angle of the tapered outer segment surface 44 decreases toward the second segmented cone end 44. The outer segment diameter 46 also remains limited in thickness, taper angle, and dimension by the frac plug device 10 needing to pass through the narrowest portions of the borehole to reach the setting position. In the present invention, FIGS. 5-10 show that the inner cone segment surface 42 is in sliding engagement with the tapered outer core cone surface 28 of the core cone 20.

Figure 14:
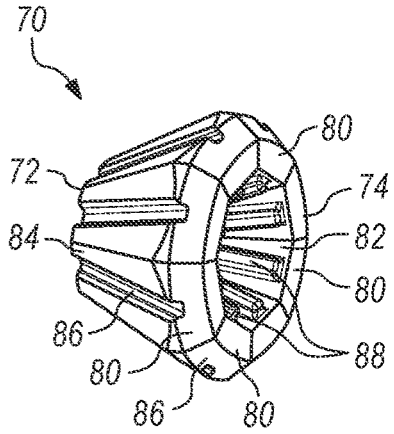
FIG. 14 is a perspective view of an embodiment of a segmented cap member of the frac plug device, according to the present invention.
Figure 16:
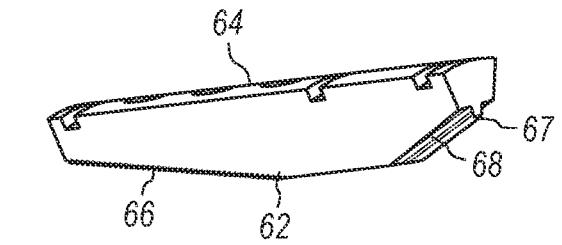
FIG. 16 is a perspective view of an embodiment of a slip segment of the frac plug device, according to the present invention.

Embodiments of the slip device 50 are shown in FIGS. 5-10 and 17. An embodiment of a slip segment 60 is shown in FIG. 16. The slip device 50 has a first slip end 52 and a second slip end 54 opposite the first slip end. FIGS. 5-10 and 17 show that the slip device 50 is comprised of a plurality of slip segments 60. As shown in FIG. 14, each slip segment 60 of the plurality of slip segments 60 has an inner slip segment surface 62 and an outer slip segment surface 64 opposite the inner slip segment surface 62. FIGS. 5-10 show the outer slip segment surface 64 of each slip segment 60 having an engagement means 69 so as to anchor a borehole wall. The engagement means 69 can be a toothed surface, grit coating, protrusions, or other known means for attaching to a borehole wall.

Figure 17:
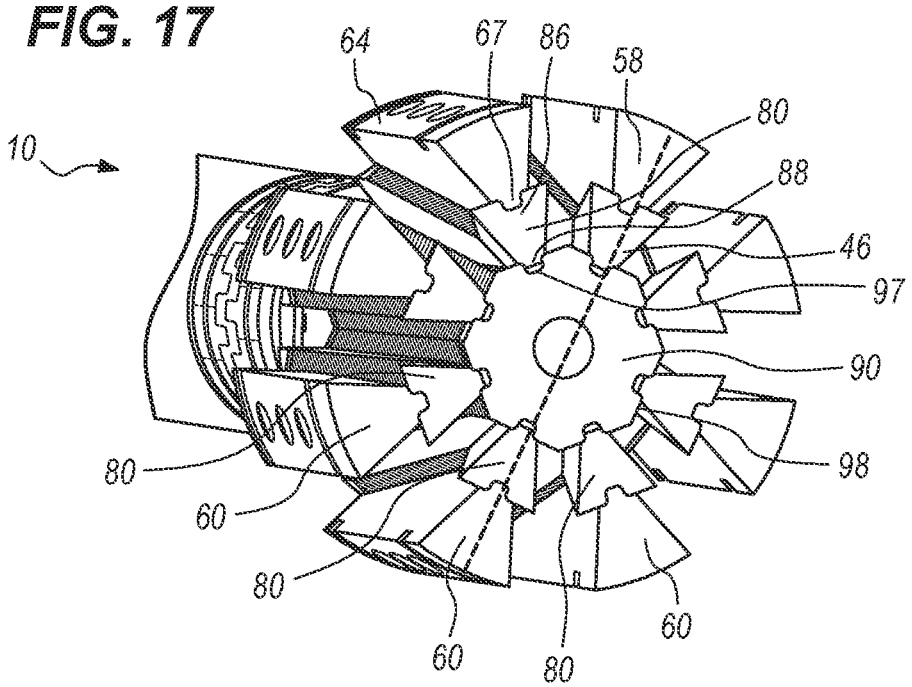
FIG. 17 is a sectional perspective view of the embodiment of the frac plug device along Line A-A in FIG. 12, according to the present invention.

The inner slip segment surface 62 is in sliding engagement with a respective tapered outer segmented cone surface 44 of each cone segment 40. Each slip segment 60 is expanded with a respective cone segment 40, as shown in FIG. 17. The radial expansion of the outer slip diameter 58 is determined by the slip device 50 and the outer segment diameter 46 of the cone segments 40 as set by the outer core diameter 29 of the core cone 20. Each slip segment 60 also remains limited in thickness, taper angle, and dimension by the frac plug device 10 needing to pass through the narrowest portions of the borehole to reach the setting position.

Embodiments of the segmented cap member 70 from FIGS. 5-10 and 17 are also shown in FIG. 14. The segmented cap member 70 has a first segmented cap end 72 and a second segmented cap end 74 opposite the first segmented cap end 72 as in FIGS. 5-10. FIG. 14 shows the segmented cap member 70 being comprised of a plurality of cap segments 80. Each cap segment 80 has an inner tapered cap segment surface 82 and an outer tapered cap segment surface 84 opposite the inner tapered cap segment surface 82.

The inner slip segment surface 62 is in sliding and locked engagement with a respective outer tapered cap segment surface 84 of each cap segment 80. Each slip segment 60 can also be expanded with a respective cap segment 80, as shown in FIG. 17. The radial expansion of the outer slip diameter 58 is supported by the cap segments 80 of the segmented cap member 70. The cap segments 80 hold the position of the slip segments 60 around the segmented cone 30 and the core cone 20. The slip segments 60 are stacked around the cone segments 40 around the core cone 20. The risk of toppling or misaligning to collapse the slip segments 60 back to the core cone 20 is avoided by the cap segments 80.

Figure 15:
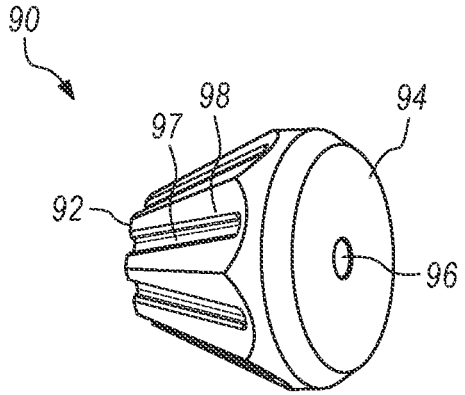
FIG. 15 is a perspective view of an embodiment of a core cap member of the frac plug device, according to the present invention.

Embodiments of the core cap member 90 from FIGS. 5-10 and 17 are also shown in FIG. 15. The core cap member 90 has a first core cap end 92 and a second core cap end 94 opposite the first second cap end 92. There is an inner core cap channel 96 extending from the first core cap end 92 to the second core cap end 94. The mandrel or other tubular member extending through the core cone 20 can also extend through the inner core cap channel 96 to implement the setting action of the frac plug device 10. The core cap member 90 has a tapered outer core cap surface 98 decreasing in outer core cap diameter 99 toward the first core cap end 92. The taper angle of the core cap member 90 is in an opposite direction from the taper angle of the core cone 20.

The inner tapered cap segment surface 82 of each cap segment is in sliding and locked engagement with the tapered outer core cap surface 98 of the core cap member 90. While the cap segments 80 hold the position of the slip segments 60 around the segmented cone 30 and the core cone 20, the core cap member 90 holds the cap segments 80 around the core cap member 90. The slip segments 60 are also stacked around the cap segments 80 around the core cap member 90. The risk of toppling or misaligning to collapse the slip segments 60 back to the core cap member 90 is also avoided by the cap segments 80.

In the full expansion configuration with the core cone 20 and the core cap member 90, the second core cone end 24, the second segmented cone end 34, the first segmented cap end 72, and the first core cap end 92 are within the slip device 50. The outer slip diameter 58 of the slip device in the full expansion configuration is comprised of the slip device 50 and the outer segment diameter 46 of the segmented cone 30 as set by the outer core cone diameter 29 of the core cone 20. The outer slip diameter 58 is no longer limited by the thickness, taper angle, and dimension by the frac plug device 10 needing to pass through the narrowest portions of the borehole to reach the setting position. Even though each slip segment 60 remains limited in thickness, taper angle, and dimension, the outer slip diameter 58 of the slip device 50 in the present invention is no longer limited. The frac plug device 10 of the present invention now passes through the narrowest portions of the borehole to reach the setting position and achieves high expansion for the setting position in larger diameters of the borehole. Additionally, the maximum radial expansion in the full expansion configuration is stable and locked by the segmented cap member 70 and core cap member 90.

As radial expansion of each slip segment 60 to the outer slip diameter 58 is maximized by the cone segments 40 on the core cone 20, the stacking on the cap segments 80 on the core cap member 90 also can expand to the final expansion configuration, as shown in FIG. 17. While the cap segments 80 hold the position of the slip segments 60 around the segmented cone 30 and the core cone 20, the cap segments 80 are in sliding and locked engagement around the core cap member 90. The slip segments 60 are stacked on the cone segments 40 around the core cone 20 and on the cap segments 80 around the core cap member 90. Each slip segment 60 is locked in position around the core cone 20 by both a respective cap segment 80 and the core cap member 90. In FIGS. 9-10 for the final expansion configuration, the second segmented cone end 34 is in contact with the first segmented cap end 72 within the slip device 50. The second core end 24 can also be in contact with the first core cap end 92 within the slip device 50 for the final expansion configuration. The contact can set the taper angles of all cooperative tapered surfaces 28, 44, 62, 66, 68, 82, 84, and 98 and prevent over expansion around the core cap member 90.

Embodiments of the frac plug device 10 also include a segmented cone support ring 36 removably engaged with the plurality of cone segments 40 at the first segmented cone end 32 and a segmented cap member support ring 76 removably engaged with the plurality of cap segments 80 at the second segmented cap end 74. FIGS. 5-6 show the segmented cone support ring 36 around the cone segments 40 and the segmented cap member support ring 76 around the cap segments in the run-in configuration. FIGS. 7-8 show the segmented cone support ring 36 around the cone segments 40 and the segmented cap member support ring 76 around the cap segments in the initial expansion configuration. FIGS. 9-10 finally show the segmented cone support ring 36 removed from the cone segments 40 and the segmented cap member support ring 76 removed from the cap segments in the final expansion configuration.

FIGS. 5-10 also show embodiments of the frac plug device with at least one slip support ring 56 removably engaged with the slip segments 60. FIGS. 5-6 show three slip support rings 56 around the slip segments 60 in the run-in configuration. FIGS. 7-10 show the slip support rings 56 removed from the slip segments 60 in both the initial expansion configuration of FIGS. 7-8 and the final expansion configuration of FIGS. 9-10. All support rings 36, 56, 76 are removed in the full expansion configuration in FIGS. 9, 10 and 17. The support rings 36, 56, 76 control the amount of force needed to expand the corresponding pluralities of slip segments 60, cone segments 40, and cap segments 80. Premature expansion is prevented so that the frac plug device 10 can be expanded only at the desired setting position in the borehole.

The present invention includes the run-in configuration with the core cone 20 and the core cap member 90 having the second core cone end 24 at the first segmented cone end 32, the second segmented cone end 34 at the first slip end 52, the second slip end 54 at the first segmented cap end 72, and the second segmented cap end 74 at the first core cap end 92. The outer slip diameter 58 in the run-in configuration is thickness, taper angle, and dimension of the slip device 50.

In embodiments with the support rings 36, 56, 76, the segmented cone support ring 36, the segmented cone support ring 76, and the slip support rings 56 are respectively engaged in the run-in configuration to prevent accidental or premature expansion of any of the segmented cone 30, the slip device 50, and the segmented cap member 70.

Embodiments of the present invention further include the initial expansion configuration with the core cone 20 and the core cap member 90 having the second core cone end 24 at the first segmented cone end 32, the second segmented cone end 34 and the first segmented cap end 72 within the slip device 50, and the second segmented cap end 74 at the first core cap end 92. The outer slip diameter 58 in the initial expansion configuration is comprised of thickness, taper angle, and dimension of the slip device 50 and the outer segment diameter 46 of the segmented cone 30. There is no relationship to the core cone 20 to set the outer slip diameter 58 in the initial expansion configuration. The second segmented cone end 34 can be in contact with the first segmented cap end 72 within the slip device 50 in the initial expansion configuration.

In embodiments with the support rings 36, 56, 76, the segmented cone support ring 36, the segmented cone support ring 76, and the slip support rings 56 are still respectively engaged in the initial expansion configuration to prevent accidental or premature expansion of any of the segmented cone 30 and the segmented cap member 70. The slip support rings 56 are removed from the slip segments 60 in the initial expansion configuration. The slip device 50 can expand, and the outer slip diameter 58 may be sufficient to attach to the borehole with a compatible borehole diameter. Alternatively, the initial expansion configuration is an intermediate configuration during the transition from the run-in configuration to the full expansion configuration.

FIG. 16 shows a particular embodiment of a slip segment 60 of the slip device 50. In this embodiment, each inner slip segment surface 62 is comprised of a first tapered inner slip portion 66 and a second tapered inner slip portion 68. The first tapered inner slip portion 66 is in sliding engagement with a respective tapered outer segmented cone surface 44 of a corresponding cone segment 40. The second tapered inner slip portion 68 is in sliding and locked engagement with a respective outer tapered cap segment surface 84 of a corresponding cap segment 80. The first tapered inner slip portion 66 can be tapered toward the second tapered inner slip portion 68. The first tapered inner slip portion 66 and the second tapered inner slip portion 68 can also be opposite each other.

FIGS. 14, 16, and 17 further show the sliding and locked engagement between the slip segments 60 and the cap segments 80. FIG. 14 shows the outer tapered cap segment surface 84 being comprised of an outer tapered cap groove 86, and FIG. 16 shows the inner slip segment surface 62 being comprised of an inner slip ridge 67. In some embodiments, the second tapered inner slip portion 68 of the inner slip segment surface 62 has the inner slip ridge 67. FIG. 17 shows the sliding engagement along the inner slip ridge 67 in the outer tapered cap groove 86 and the locked engagement of the slip segment 60 held to the cap segment 80. The plurality of slip segments 60 are locked around the segmented cap member 70 so that the slip segments 60 do not radially shift around the segmented cap member 70.

FIGS. 14, 15, and 17 further show the sliding and locked engagement between the cap segments 80 and the core cap member 90. FIG. 14 shows the inner tapered cap segment surface 82 being comprised of an inner tapered cap ridge 88. FIG. 15 shows the tapered outer core cap surface 84 being comprised of an outer cap groove 97. FIG. 17 shows the sliding engagement along the inner tapered cap ridge 88 in the outer cap groove 97 and the locked engagement of the cap segment 80 held to the core cap member 90. The cap segments 80 cannot radially shift around the core cap member 90. The cap segments 80 are held in place around the core cap member 90, and the slip segments 60 are locked to the cap segments 80 so that the slip segments 60 remain in the final expansion configuration. The slip segments 60 are set by the cone segments 40 with sliding engagement. Additional gripping means, like textured surfaces, spiral threads or other surface interactions can be used between the slip segments 60 and the cone segments 40.

The present invention includes the method for sealing a borehole with the frac plug device 10. The method includes the step of deploying the frac plug device 10 in a borehole to a downhole location with the frac plug device 10 in the run-in configuration of the core cone 20 and the core cap member 90. When ready to seal by expansion of the slip device 50, the method includes moving the segmented cone 30 toward the segmented cap member 70 within the slip device 50 and placing the core cone 20 and the core cap member 90 in the initial expansion configuration. The outer slip diameter 58 is comprised of the slip device 50 and the outer segment diameter 46 of the segmented cone 30 in the initial expansion configuration.

The method includes the step of moving the core cone 20 toward the core cap member 90 within the slip device 50. The intermediate step in the initial expansion configuration is temporary. The maximum radial expansion of the slip device 50 has not yet been reached. The method then includes the step of placing the core cone 20 and the core cap member 90 in the full expansion configuration with the outer slip diameter 58 being comprised of the slip device 50 and the outer segment diameter 46 as set by the outer core cone diameter 29.

Embodiments of the method of the present invention include the frac plug device 10 being comprised of the segmented cone support ring 36 removably engaged with the plurality of cone segments 40, the segmented cap member support ring 76 removably engaged with the plurality of cap segments 80, and at least one slip support ring 56 removably engaged with the plurality of slip segments 60. The step of deploying in the run-in configuration includes the segmented cone support ring 36 being engaged with the plurality of cone segments 40, the segmented cap member support ring 76 being engaged with the plurality of cap segments 80, and at least one slip support ring 56 being engaged with the plurality of slip segments 60. The step of placing the core cone and the core cap member in the initial expansion configuration further includes the segmented cone support ring 36 beings engaged with the plurality of cone segments 40, the segmented cap member support ring 76 being engaged with the plurality of cap segments 80, and the slip support ring 56 being removed from the plurality of slip segments 60. The slip device 50 is allowed to radial expand in the initial expansion configuration to an intermediate amount of expansion. Choosing the strength of the slip support rings 56 can control premature or accidental expansion.

The step of placing the core cone 20 and the core cap member 90 in the final expansion configuration further includes the segmented cone support ring 36 being removed from the plurality of cone segments 40 and the segmented cap member support ring 76 being removed from the plurality of cap segments 80. The slip support rings 56 have already been removed from the plurality of slip segments 60 so the slip device 50 can move the maximum radial expansion with the outer slip diameter 58 as a combination of the thickness, taper angle, and dimension of the slip segments 60, the thickness, taper angle, and dimension of the cone segments 40, and the thickness, taper angle, and dimension of the core cone 20, in particular the outer core cone diameter 29.

Embodiments of the method include the step of placing the core cone 20 and the core cap member 90 in the full expansion configuration further comprising the step of locking the slip device 50 around the core cone 20 in the full expansion configuration. The locking prevents misalignment and collapse of the slip segments 60 to the core cone 20 or core cap member 90. The step of locking the slip device 50 around the core cone 20 comprises the steps of sliding the inner slip segment surface 62 along a respective outer tapered cap segment surface 84 of each cap segment 80 and sliding the inner tapered cap segment surface 82 along a respective tapered outer core cap surface 98 of the core cap member 90. FIG. 17 shows the outer tapered cap segment surface 84 is comprised of an outer tapered cap groove 86 and the inner slip segment surface is comprised of an inner slip ridge 67 so as to lock each slip segment 60 to a respective cap segment 80 the segmented cap member 70 as the inner slip segment surface 62 slides along a respective outer tapered cap segment surface 84. FIG. 17 also shows the inner tapered cap segment surface 82 is comprised of an inner tapered cap ridge 88, and the tapered outer core cap surface 98 is comprised of an outer cap groove 97 so as to lock each cap segment 80 around the core cap member 90 as the inner tapered cap segment surface 82 slides along a respective tapered outer core cap surface 98.

The present invention provides a frac plug device able to span large wellbores and casings so as to seal the borehole at setting positions in these larger diameter portions of the borehole. The final expansion configuration is no longer limited by the thickness, taper angle, and dimensions for passing through the narrowest portion of the borehole during deployment to the setting position. The frac plug device of the present remains a wedge type or ramp type frac plug with fewer components and simplified setting action. The segmented cone and the segmented cap member are compatible with the core cone and the core cap member in a simplified setting action. The outer slip diameter in the final expansion configuration is the maximum radial expansion to span larger diameters in the borehole. The thickness, taper angle, and dimensions of the slip device and now the outer segment diameter and the outer core cone diameter determine the maximum radial expansion. A high expansion of the slip device at the setting positions in larger diameter portions of the borehole allows the frac plug device to seal in the desired locations, even if the borehole is wider. The frac plug device further remains useful for setting positions in regular portions of the borehole. The multiple stage expansion from run-in configuration to initial expansion configuration and to final expansion configuration allows the intermediate stage of the initial expansion configuration to be used to seal at a setting position in a regular portion of the borehole. The present invention further locks the slip segments around the core cone so that the risk of misalignment and collapse is reduced. The cone segments still expand the slips along slidable tapered surface interaction. The cap segments and core cap member both slide and lock the radial positions of the slip segments around the core cone and core cap member without interfering with the simplified setting action of the core cone and segmented cone. The frac plug device of the present invention has high expansion at setting positions in large diameter portions of the borehole and can stably seal at these setting positions as a simplified wedge type or ramp type frac plug.

The foregoing disclosure and description of the invention is illustrative and explanatory thereof. Various changes in the details of the illustrated structures, construction and method can be made without departing from the true spirit of the invention.

We claim:

1. A frac plug device, comprising:

a core cone having first core cone end, a second core cone end opposite said first core cone end, an inner core cone channel extending from said first core cone end to said second core cone end, and a tapered outer core cone surface decreasing in outer core cone diameter toward said second core cone end;

a segmented cone having first segmented cone end and a second segmented cone end opposite said first segmented cone end, wherein said segmented cone is comprised of a plurality of cone segments, each cone segment of said plurality of cone segments having an inner cone segment surface and a tapered outer cone segment surface opposite said inner cone segment surface, wherein said tapered outer segment surface has an outer segment diameter decreasing toward said second segmented cone end, and wherein said inner cone segment surface is in sliding engagement with said tapered outer core cone surface;

a slip device having a first slip end, a second slip end opposite said first slip end, and an outer slip diameter, wherein said slip device is comprised of a plurality of slip segments, each slip segment of said plurality of slip segments having an inner slip segment surface and an outer slip segment surface opposite said inner slip segment surface, wherein said outer slip segment surface has an engagement means so as to anchor a borehole wall, and wherein said inner slip segment surface is in sliding engagement with a respective tapered outer segmented cone surface of each cone segment of said plurality of cone segments so as to expand each slip segment of said plurality of slip segments with a respective cone segment of said plurality of cone segments;

a segmented cap member having a first segmented cap end and a second segmented cap end opposite said first segmented cap end, wherein said segmented cap member is comprised of a plurality of cap segments, each cap segment of said plurality of cap segments having an inner tapered cap segment surface and an outer tapered cap segment surface opposite said inner tapered cap segment surface, and wherein said inner slip segment surface is in sliding and locked engagement with a respective outer tapered cap segment surface of each cap segment of said plurality of cap segments;

a core cap member having a first core cap end, a second core cap end opposite said first second cap end, an inner core cap channel extending from said first core cap end to said second core cap end, and a tapered outer core cap surface decreasing in outer core cap diameter toward said first core cap end, wherein said inner tapered cap segment surface is in sliding and locked engagement with said tapered outer core cap surface, wherein said core cone and said core cap member have a full expansion configuration with said second core cone end, said second segmented cone end, said first segmented cap end, and said first core cap end within said slip device, and wherein said outer slip diameter in said full expansion configuration is comprised of said slip device and said outer segment diameter as set by said outer core cone diameter;

a segmented cone support ring removably engaged with said plurality of cone segments at said first segmented cone end; and a segmented cap member support ring removably engaged with said plurality of cap segments at said second segmented cap end.

2. The frac plug device, according to claim 1, wherein each slip segment of said plurality of slip segments is locked in position around said core cone by a respective cap segment of said plurality of cap segment and said core cap member.

3. The frac plug device, according to claim 1, further comprising:

a slip support ring removably engaged with said plurality of slip segments.

4. The frac plug device, according to claim 1, wherein said core cone and said core cap member have a run-in configuration with said second core cone end at said first segmented cone end, said second segmented cone end at said first slip end, said second slip end at said first segmented cap end, and said second segmented cap end at said first core cap end, and wherein said outer slip diameter in said run-in configuration is comprised of said slip device.

5. The frac plug device, according to claim 4, wherein said core cone and said core cap member have an initial expansion configuration with said second core cone end at said first segmented cone end, said second segmented cone end and said first segmented cap end within said slip device, and said second segmented cap end at said first core cap end, and wherein said outer slip diameter in said initial expansion configuration is comprised of said slip device and said outer segment diameter.

6. The frac plug device, according to claim 4, further comprising:

a segmented cone support ring removably engaged with said plurality of cone segments at said first segmented cone end;

a segmented cap member support ring removably engaged with said plurality of cap segments at said second segmented cap end; and a slip support ring removable engaged with said plurality of slip segments, wherein segmented cone support ring is engaged with said plurality of cone segments and said segmented cap member support ring is engaged with said plurality of cap segments in said initial expansion configuration, and wherein said slip support ring is removed from said plurality of slip segments in said initial expansion configuration.

7. The frac plug device, according to claim 1, wherein said engagement means is selected from a group consisting of a toothed surface, a grit coating, and protrusions.

8. The frac plug device, according to claim 1, wherein said inner slip segment surface is comprised of a first tapered inner slip portion and a second tapered inner slip portion, wherein said first tapered inner slip portion is in sliding engagement with said tapered outer segmented cone surface of each cone segment of said plurality of cone segments, and wherein said second tapered inner slip portion is in sliding and locked engagement with a respective outer tapered cap segment surface of a corresponding cap segment of said plurality of cap segments.

9. The frac plug device, according to claim 8, wherein said first tapered inner slip portion is tapered toward said second tapered inner slip portion.

10. The frac plug device, according to claim 1, wherein said inner tapered cap segment surface is comprised of an inner tapered cap ridge, and wherein said tapered outer core cap surface is comprised of an outer cap groove in sliding engagement with said inner tapered cap ridge so as to lock each cap segment of said plurality of cap segments around said core cap member.

11. A frac plug device, comprising:

a core cone having first core cone end, a second core cone end opposite said first core cone end, an inner core cone channel extending from said first core cone end to said second core cone end, and a tapered outer core cone surface decreasing in outer core cone diameter toward said second core cone end;

a segmented cone having first segmented cone end and a second segmented cone end opposite said first segmented cone end, wherein said segmented cone is comprised of a plurality of cone segments, each cone segment of said plurality of cone segments having an inner cone segment surface and a tapered outer cone segment surface opposite said inner cone segment surface, wherein said tapered outer segment surface has an outer segment diameter decreasing toward said second segmented cone end, and wherein said inner cone segment surface is in sliding engagement with said tapered outer core cone surface;

a slip device having a first slip end, a second slip end opposite said first slip end, and an outer slip diameter, wherein said slip device is comprised of a plurality of slip segments, each slip segment of said plurality of slip segments having an inner slip segment surface and an outer slip segment surface opposite said inner slip segment surface, wherein said outer slip segment surface has an engagement means so as to anchor a borehole wall, and wherein said inner slip segment surface is in sliding engagement with a respective tapered outer segmented cone surface of each cone segment of said plurality of cone segments so as to expand each slip segment of said plurality of slip segments with a respective cone segment of said plurality of cone segments;

a segmented cap member having a first segmented cap end and a second segmented cap end opposite said first segmented cap end, wherein said segmented cap member is comprised of a plurality of cap segments, each cap segment of said plurality of cap segments having an inner tapered cap segment surface and an outer tapered cap segment surface opposite said inner tapered cap segment surface, and wherein said inner slip segment surface is in sliding and locked engagement with a respective outer tapered cap segment surface of each cap segment of said plurality of cap segments; and a core cap member having a first core cap end, a second core cap end opposite said first second cap end, an inner core cap channel extending from said first core cap end to said second core cap end, and a tapered outer core cap surface decreasing in outer core cap diameter toward said first core cap end, wherein said inner tapered cap segment surface is in sliding and locked engagement with said tapered outer core cap surface, wherein said core cone and said core cap member have a full expansion configuration with said second core cone end, said second segmented cone end, said first segmented cap end, and said first core cap end within said slip device, wherein said outer slip diameter in said full expansion configuration is comprised of said slip device and said outer segment diameter as set by said outer core cone diameter, wherein said outer tapered cap segment surface is comprised of an outer tapered cap groove, and wherein said inner slip segment surface is comprised of an inner slip ridge in sliding engagement with said outer tapered cap groove so as to lock each slip segment of said plurality of slip segments around said segmented cap member.

12. The frac plug device, according to claim 11, wherein said inner slip segment surface is comprised of a first tapered inner slip portion and a second tapered inner slip portion, and wherein said inner slip ridge is on said second tapered inner slip portion.

13. A method for sealing a borehole, comprising the steps of:

deploying a frac plug device in a borehole to a downhole location, said core cone and said core cap member being in said run-in configuration;

moving said segmented cone toward said segmented cap member within said slip device;

placing said core cone and said core cap member in said initial expansion configuration, said outer slip diameter being comprised of said slip device and said outer segment diameter;

moving said core cone toward said core cap member within said slip device; and placing said core cone and said core cap member in said full expansion configuration, said outer slip diameter being comprised of said slip device and said outer segment diameter as set by said outer core cone diameter, wherein said frac plus device comprises:

a core cone having first core cone end, a second core cone end opposite said first core cone end, an inner core cone channel extending from said first core cone end to said second core cone end, and a tapered outer core cone surface decreasing in outer core cone diameter toward said second core cone end;

a segmented cone having first segmented cone end and a second segmented cone end opposite said first segmented cone end, wherein said segmented cone is comprised of a plurality of cone segments, each cone segment of said plurality of cone segments having an inner cone segment surface and a tapered outer cone segment surface opposite said inner cone segment surface, wherein said tapered outer segment surface has an outer segment diameter decreasing toward said second segmented cone end, and wherein said inner cone segment surface is in sliding engagement with said tapered outer core cone surface;

a slip device having a first slip end, a second slip end opposite said first slip end, and an outer slip diameter, wherein said slip device is comprised of a plurality of slip segments, each slip segment of said plurality of slip segments having an inner slip segment surface and an outer slip segment surface opposite said inner slip segment surface, wherein said outer slip segment surface has an engagement means so as to anchor a borehole wall, and wherein said inner slip segment surface is in sliding engagement with a respective tapered outer segmented cone surface of each cone segment of said plurality of cone segments so as to expand each slip segment of said plurality of slip segments with a respective cone segment of said plurality of cone segments;

a segmented cap member having a first segmented cap end and a second segmented cap end opposite said first segmented cap end, wherein said segmented cap member is comprised of a plurality of cap segments, each cap segment of said plurality of cap segments having an inner tapered cap segment surface and an outer tapered cap segment surface opposite said inner tapered cap segment surface, and wherein said inner slip segment surface is in sliding and locked engagement with a respective outer tapered cap segment surface of each cap segment of said plurality of cap segments;

a core cap member having a first core cap end, a second core cap end opposite said first second cap end, an inner core cap channel extending from said first core cap end to said second core cap end, and a tapered outer core cap surface decreasing in outer core cap diameter toward said first core cap end, wherein said inner tapered cap segment surface is in sliding and locked engagement with said tapered outer core cap surface, wherein said core cone and said core cap member have a full expansion configuration with said second core cone end, said second segmented cone end, said first segmented cap end, and said first core cap end within said slip device, wherein said outer slip diameter in said full expansion configuration is comprised of said slip device and said outer segment diameter as set by said outer core cone diameter, wherein said core cone and said core cap member have a run-in configuration with said second core cone end at said first segmented cone end, said second segmented cone end at said first slip end, said second slip end at said first segmented cap end, and said second segmented cap end at said first core cap end, wherein said outer slip diameter in said run-in configuration is comprised of said slip device, wherein said core cone and said core cap member have an initial expansion configuration with said second core cone end at said first segmented cone end, said second segmented cone end and said first segmented cap end within said slip device, and said second segmented cap end at said first core cap end, and wherein said outer slip diameter in said initial expansion configuration is comprised of said slip device and said outer segment diameter;

a segmented cone support ring removably engaged with said plurality of cone segments at said first segmented cone end;

a segmented cap member support ring removably engaged with said plurality of cap segments at said second segmented cap end; and a slip support ring removably engaged with said plurality of slip segments, wherein said segmented cone support ring is engaged with said plurality of cone segments, said segmented cap member support ring is engaged with said plurality of cap segments, and said slip support ring is engaged with said plurality of slip segments in said run-in configuration.

14. The method for sealing, according to claim 13, wherein said segmented cone support ring is engaged with said plurality of cone segments and said segmented cap member support ring is engaged with said plurality of cap segments in said initial expansion configuration, and wherein said slip support ring is removed from said plurality of slip segments in said initial expansion configuration.

15. The method for sealing, according to claim 13, wherein said segmented cone support ring is removed from said plurality of cone segments, wherein said segmented cap member support ring is removed from said plurality of cap segments, and wherein said slip support ring is removed from said plurality of slip segments in said full expansion configuration.

16. The method for sealing, according to claim 13, wherein the step of placing said core cone and said core cap member in said full expansion configuration further comprises the step of:

locking said slip device around said core cone in said full expansion configuration.

17. The method for sealing, according to claim 16, wherein the step of locking said slip device around said core one comprising:

sliding said inner slip segment surface along a respective outer tapered cap segment surface of each cap segment of said plurality of cap segments; and sliding said inner tapered cap segment surface along a respective tapered outer core cap surface.

18. The method for sealing, according to claim 17, wherein said outer tapered cap segment surface is comprised of an outer tapered cap groove, wherein said inner slip segment surface is comprised of an inner slip ridge so as to lock each slip segment of said plurality of slip segments around said segmented cap member, wherein said inner tapered cap segment surface is comprised of an inner tapered cap ridge, and wherein said tapered outer core cap surface is comprised of an outer cap groove so as to lock each cap segment of said plurality of cap segments around said core cap member.

* * * * *